US009711031B2

(12) United States Patent
Kawamoto et al.

(10) Patent No.: US 9,711,031 B2
(45) Date of Patent: Jul. 18, 2017

(54) COMMUNICATION STATE DISPLAY METHOD AND COMMUNICATION STATE DISPLAY DEVICE

(71) Applicant: AZBIL CORPORATION, Chiyoda-ku (JP)

(72) Inventors: Masanori Kawamoto, Chiyoda-ku (JP); Naoki Ishii, Chiyoda-ku (JP)

(73) Assignee: AZBIL CORPORATION, Chiyoda-ku (JP)

( * ) Notice: Subject to any disclaimer, the term of this patent is extended or adjusted under 35 U.S.C. 154(b) by 0 days.

(21) Appl. No.: 14/933,699

(22) Filed: Nov. 5, 2015

(65) Prior Publication Data

US 2016/0133112 A1 May 12, 2016

(30) Foreign Application Priority Data

Nov. 6, 2014 (JP) ..... 2014-225829

(51) Int. Cl.
*G08B 21/18* (2006.01)
*G08B 5/36* (2006.01)

(52) U.S. Cl.
CPC ..... *G08B 21/18* (2013.01); *G08B 5/36* (2013.01)

(58) Field of Classification Search
CPC ..... G08B 21/18; G08B 5/36; G08C 24/04; H02M 7/217; H05B 37/02; H05B 33/0824; H05B 3/0833; H05B 33/0815
See application file for complete search history.

(56) References Cited

U.S. PATENT DOCUMENTS 4,873,483 A * 10/1989 Ostrander ..... G01W 1/16 324/72
5,838,471 A * 11/1998 Beard ..... H04B 10/11 370/286
6,020,593 A * 2/2000 Chow ..... H04B 10/032 250/214 LS
2011/0001440 A1* 1/2011 Deurenberg ..... H05B 33/0815 315/307
2011/0182094 A1* 7/2011 Lumsden ..... H02J 1/14 363/126
2012/0187845 A1* 7/2012 Saes ..... H05B 33/0818 315/113
2013/0272714 A1* 10/2013 Ohkubo ..... G08C 23/04 398/106
2016/0036349 A1* 2/2016 Steiner ..... H02M 7/217 315/307
2016/0133112 A1* 5/2016 Kawamoto ..... G08B 21/18 340/664

* cited by examiner

*Primary Examiner* — An T Nguyen
(74) *Attorney, Agent, or Firm* — Oblon, McClelland, Maier & Neustadt, L.L.P.

(57) ABSTRACT

Provided is a communication state display method, the method being used to check a communication state of a communication device that transmits/receives signals to/from a different apparatus by serial communication, the method including: stretching a pulse width of a signal transmitted/received between the communication device and the different apparatus by serial communication; and causing current to flow through an indicator in response to the signal having the stretched pulse width to light the indicator during the current flow.

4 Claims, 4 Drawing Sheets

COMMUNICATION STATE DISPLAY METHOD AND COMMUNICATION STATE DISPLAY DEVICE

CROSS-REFERENCE TO RELATED APPLICATIONS

This application claims priority to Japanese Application No. 2014-225829, filed Nov. 6, 2014, the entire contents of which are incorporated herein by reference.

BACKGROUND

The present disclosure relates to a communication state display method and a communication state display device that allow the communication state in general-purpose serial communication to be checked by lighting of an indicator such as an LED.

In the past, general-purpose serial communication (RS232, RS485, and the like) has generally been used for communication between, for example, industrial apparatuses. Features of each type of serial communication are shown in Table 1 (see "Feature comparison between RS232/RS422/RS485," NIHON ELECTRIC WIRE & CABLE CO., LTD., <http://www.nihondensen.co.jp/?p=376>).

TABLE 1

| | | | RS232 | RS422 | RS485 |
|---|---|---|---|---|---|
| Transmission path | | | Unbalanced | Balanced | Balanced |
| Transmission speed | Minimum | Speed | — | Not more than 90 kbps | Not more than 90 kbps |
| | | Distance | — | 1200 m | 1200 m |
| | Maximum | Speed | 19.2 kbps | 10 Mbps | 10 Mbps |
| | | Distance | — | 15.2 m | 15.2 m |
| Connector | | | D-sub25 pin<br>D-sub9 pin | Not specified | Not specified |
| Termination resistor | | | — | One terminal (input side) | Both terminals |
| Connectable number | | | Point-to-point<br>(1 to 1) | Multidrop<br>(1 to 10) | Multidrop<br>(Multi-to-multi: 32 at most) |
| Communication system | | | Full duplex | Full duplex | Half duplex |

An industrial apparatus having a serial communication function may use an indicator such as a light emitting diode (LED) to display the physical transmission state and reception state in order to check the serial communication wiring, for example. Examples of a method of displaying communication state include (1) a method of driving an indicator such as an LED with a transmission signal or reception signal for serial communication and (2) a method of driving an indicator such as an LED by a controller such as a central processing unit (CPU) incorporated in an industrial apparatus to display the communication state of the controller.

As the method (2), a serial communication system in which the wiring can be checked by outputting, by the CPU of a control unit, a checking signal to a plurality of terminal units connected to a serial signal line, returning, by each terminal unit, the number of channels of their own in response to the checking signal, and listing, by a host controller connected to the control unit, the received number of channels is proposed (see Japanese Patent Application Laid-open No. 2002-369272). It should be noted that the method (2) needs a CPU and the like, resulting in complicated structure. On the other hand, the method (1) is superior in that it does not use resources such as capabilities of the CPU and programs to display the communication state.

SUMMARY

The speed of general-purpose serial communication is not specifically defined by the standards. However, as shown in Table 1, the speed can be from 90 kbps to 10 Mbps. In the past, the general-purpose serial communication has often been used at a relatively low speed (not more than 100 kbps). In recent years, however, the general-purpose serial communication is becoming used for, for example, an industrial communication bus even at the speed beyond 100 kbps because of increase in CPU speed or improvement in the capability of the general-purpose transceiver.

If an indicator such as an LED is driven with a transmission signal or reception signal for serial communication as in the method (1), it needs a sufficient signal pulse width to turn on the LED. If the communication speed is more than 100 kbps, the LED does not light enough to be visually confirmed if a signal is used to drive the LED. Such a problem occurs because the pulse width of the signal is short, i.e., 10 μs at the speed of 100 kbps. In order to allow the lighting of the LED to be visually confirmed, it needs a pulse width of not less than 500 μs, for example.

The present disclosure has been made to solve the above-mentioned problems, and an object of the present disclosure is to provide a communication state display method and a communication state display device that allow the communication state to be checked with a simple structure even at a high serial communication speed.

According to an embodiment of the present disclosure, there is provided a communication state display method, the method being used to check a communication state of a communication device that transmits/receives signals to/from a different apparatus by serial communication, the method including stretching a pulse width of a signal transmitted/received between the communication device and the different apparatus by serial communication, and causing current to flow through an indicator in response to the signal having the stretched pulse width to light the indicator during the current flow.

According to an embodiment of the present disclosure, there is provided a communication state display device of a communication device that transmits/receives signals to/from a different apparatus by serial communication, including an indicator driving circuit configured to cause current to flow through an indicator in response to an input signal to light the indicator during the current flow, and a pulse stretching circuit configured to stretch a pulse width of a signal transmitted/received between the communication device and the different apparatus by serial communication and to input the signal having the stretched pulse width to the indicator driving circuit.

In the communication state display device, the pulse stretching circuit includes a diode configured to not delay rising of a positive pulse signal, the positive pulse signal being a 1-bit signal whose voltage level in serial communication is switched from low, to high, and to low again, and to transmit the positive pulse signal as it is if the positive pulse signal is input to the pulse stretching circuit, and an RC circuit that includes a resistor and a capacitor and is configured to delay falling of the positive pulse signal to stretch the pulse width, and the indicator driving circuit is configured to cause current to flow through the indicator in response to the positive pulse signal input from the pulse stretching circuit.

In the communication state display device, the pulse stretching circuit includes a diode configured to not delay falling of a 1-bit signal whose voltage level in serial communication is switched from high, to low, to high again, which is defined as a negative pulse signal, and to transmit the negative pulse signal as it is if the negative pulse signal is input to the pulse stretching circuit, and an RC circuit that includes a resistor and a capacitor and is configured to delay rising of the negative pulse signal to stretch the pulse width, and the indicator driving circuit is configured to cause current to flow through the indicator in response to the negative pulse signal input from the pulse stretching circuit.

According to an embodiment of the present disclosure, it is possible to stretch the pulse width of a high-speed transmission signal or reception signal to one that can be visually confirmed by lighting of an indicator even at a high serial communication speed, and to allow the lighting of the indicator depending on the signal transmitted/received between a communication device and a different apparatus to be visually confirmed. As a result, according to the embodiment of the present disclosure, it is possible to check the communication state with a simple structure that does not use resources such as capabilities of the CPU and programs even at a high serial communication speed, and to check the error in the wiring, for example.

DETAILED DESCRIPTION OF EMBODIMENTS

Hereinafter, embodiments of the present disclosure will be described with reference to the drawings.

First Embodiment

Figure 1:
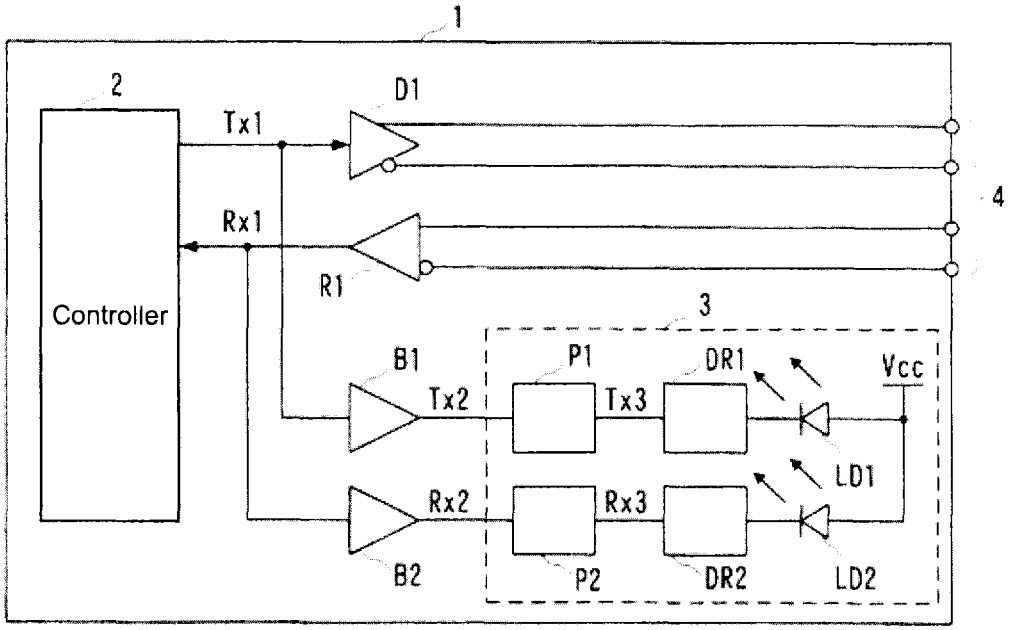
FIG. 1 is a block diagram showing the structure of a communication device according to a first embodiment of the present disclosure.

FIG. 1 is a block diagram showing the structure of a communication device according to a first embodiment of the present disclosure. A communication device 1 is provided in an industrial apparatus (not shown) or as a single apparatus, and includes a controller 2 configured to communicate with a different apparatus via a serial communication terminal 4, such as a CPU, a communication state display device 3, a serial communication driver D1 that is provided between the output terminal of the controller 2 and the serial communication terminal 4 and is configured to transmit a transmission signal Tx1 received from the controller 2 to the serial communication terminal 4, a serial communication receiver R1 that is provided between the input terminal of the controller 2 and the serial communication terminal 4 and is configured to send a reception signal Rx1 received from the serial communication terminal 4 to the controller 2, a buffer B1 configured to display the transmission state of the communication device 1, and a buffer B2 configured to display the reception state of the communication device 1.

The communication state display device 3 includes a transmission state indicator LD1 made of an LED whose anode is connected to a power source voltage Vcc, a reception state indicator LD2 made of an LED whose anode is connected to the power source voltage Vcc, a transmission state indicator driving circuit DR1 configured to drive the transmission state indicator LD1, a reception state indicator driving circuit DR2 configured to drive the reception state indicator LD2, a transmission signal pulse stretching circuit P1 that is provided between the output terminal of the buffer B1 and the input terminal of the transmission state indicator driving circuit DR1 and is configured to stretch the pulse width of the transmission signal, and a reception signal pulse stretching circuit P2 that is provided between the output terminal of the buffer B2 and the input terminal of the reception state indicator driving circuit DR2 and is configured to stretch the pulse width of the reception signal.

In FIG. 1, Tx2 represents the transmission signal input from the controller 2 after passing through the buffer B1, Rx2 represents the reception signal input from the serial communication receiver R1 after passing through the buffer B2, Tx3 represents the transmission signal whose pulse width has been stretched by the transmission signal pulse stretching circuit P1, and Rx3 represents the reception signal whose pulse width has been stretched by the reception signal pulse stretching circuit P2.

The transmission signal Tx1 received from the controller 2 is output to the serial communication terminal 4 via the serial communication driver D1. Furthermore, the transmission signal Tx1 is input to the transmission signal pulse stretching circuit P1 via the buffer B1, and the transmission state indicator driving circuit DR1 drives the transmission state indicator LD1 in response to the transmission signal Tx3 whose pulse width has been stretched by the transmission signal pulse stretching circuit P1.

The reception signal Rx1 received from the serial communication terminal 4 is input to the controller 2 via the serial communication receiver R1. Furthermore, the reception signal Rx1 is input to the reception signal pulse stretching circuit P2 via the buffer B2, and the reception state indicator driving circuit DR2 drives the reception state indicator LD2 in response to the reception signal Rx3 whose pulse width has been stretched by the reception signal pulse stretching circuit P2.

Figure 2:
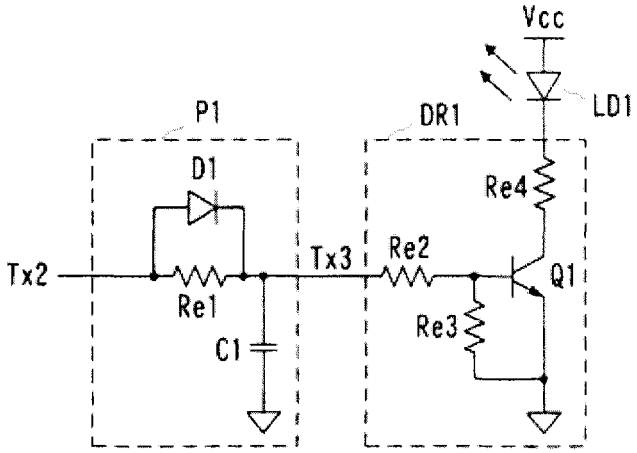
FIG. 2 is a circuit diagram showing an example of the structure of a transmission signal pulse stretching circuit and transmission state indicator driving circuit according to the first embodiment.

FIG. 2 is a circuit diagram showing an example of the structure of the transmission signal pulse stretching circuit P1 and the transmission state indicator driving circuit DR1. The transmission signal pulse stretching circuit P1 includes a diode D1 whose anode is connected to the input terminal of the transmission signal pulse stretching circuit P1 (output terminal of the buffer B1) and whose cathode is connected to the output terminal of the transmission signal pulse stretching circuit P1 (input terminal of the transmission state indicator driving circuit DR1), a resistor Re1 whose one end is connected to the input terminal of the transmission signal pulse stretching circuit P1 and whose other end is connected to the output terminal of the transmission signal pulse stretching circuit P1, and a capacitor C1 whose one end is connected to the output terminal of the transmission signal pulse stretching circuit P1 and whose other end is grounded.

The transmission state indicator driving circuit DR1 includes an NPN transistor Q1 whose emitter is grounded, a resistor Re2 whose one end is connected to the input terminal of the transmission state indicator driving circuit DR1 and whose other end is connected to the base of the transistor Q1, a resistor Re3 whose one end is connected to the other end of the resistor Re2 and the base of the transistor Q1 and whose other end is grounded, and a resistor Re4 whose one end is connected to the collector of the transistor Q1 and whose other end is connected to the output terminal of the transmission state indicator driving circuit DR1 (cathode of the transmission state indicator LD1).

Figure 3:
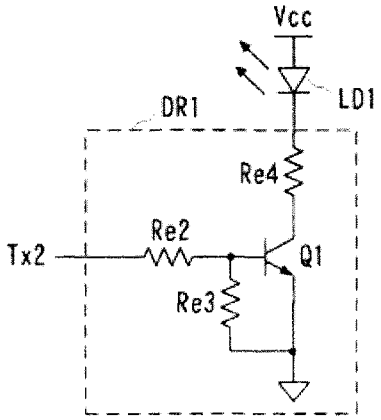
FIG. 3 is a circuit diagram showing an example of the structure of an existing communication state display device.

FIG. 3 is a circuit diagram showing an example of the structure of an existing communication state display device. Here, only the structure on the side of the transmission signal is shown. From FIG. 2 and FIG. 3, it can be seen that the communication state display device 3 according to this embodiment is obtained by adding the transmission signal pulse stretching circuit P1 and the reception signal pulse stretching circuit P2 to the existing communication state display device.

Figure 4:
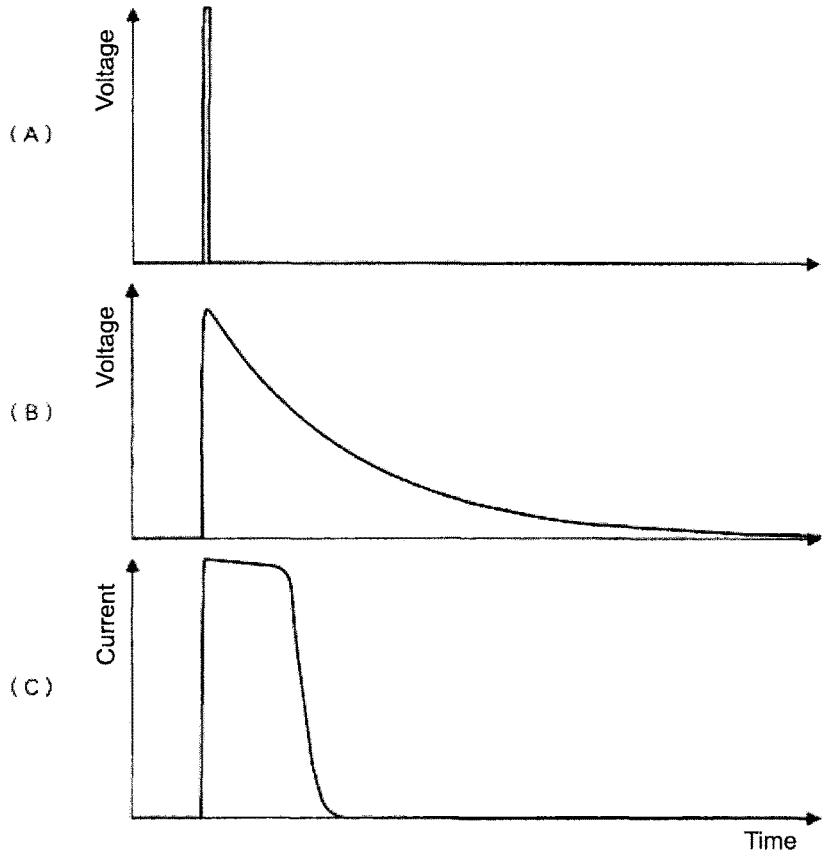
FIG. 4 are each a diagram showing the signal waveform of each unit of the transmission signal pulse stretching circuit and transmission state indicator driving circuit according to the first embodiment.

FIGS. 4A, 4B, and 4C are each a diagram showing the signal waveform of each unit of the transmission signal pulse stretching circuit P1 and the transmission state indicator driving circuit DR1. FIG. 4A is a diagram showing the voltage waveform of the transmission signal Tx2 input from the buffer B1 to the transmission signal pulse stretching circuit P1, FIG. 4B is a diagram showing the voltage waveform of the transmission signal Tx3 whose pulse width has been stretched by the transmission signal pulse stretching circuit P1, and FIG. 4C is a diagram showing the waveform of the current flowing through the transmission state indicator LD1.

If the transmission signal Tx2 of 1-bit data shown in FIG. 4A in serial communication is input to the transmission signal pulse stretching circuit P1, the transmission signal Tx3 having a waveform shown in FIG. 4B is input to the transmission state indicator driving circuit DR1. Specifically, the diode D1 does not delay the rising of the signal, and transmits the signal as it is. The resistor Re1 and the capacitor C1 delay the falling of the signal, and thus the pulse width is stretched. Because the transistor Q1 is turned on in response to the voltage whose pulse width has been stretched as described above, the turn-on time period of the transistor Q1 is prolonged as compared with that in the existing communication state display device, resulting in a longer time period during which the current flows through the transmission state indicator LD1 as shown in FIG. 4C.

In the above, the description has been made using the transmission signal pulse stretching circuit P1 and the transmission state indicator driving circuit DR1 as an example. However, the configuration of the reception signal pulse stretching circuit P2 is the same as that of the transmission signal pulse stretching circuit P1, and the configuration of the reception state indicator driving circuit DR2 is the same as that of the transmission state indicator driving circuit DR1.

AS described above, in this embodiment, the transmission signal pulse stretching circuit P1 is provided between the buffer B1 and the transmission state indicator driving circuit DR1, and the reception signal pulse stretching circuit P2 is provided between the buffer B2 and the reception state indicator driving circuit DR2. Therefore, it is possible to stretch the pulse width of a high-speed transmission signal or reception signal to one that can be visually confirmed by lighting of an LED even at a high serial communication speed (e.g., not less than 100 kbps), and to allow the lighting of the LED depending on the transmission signal or reception signal to be visually confirmed. As a result, according to the embodiment of the present disclosure, it is possible to check the communication state with a simple structure that does not use resources such as capabilities of the CPU and programs even at a high serial communication speed, and to check the error in the wiring, for example.

Second Embodiment

Figure 5:
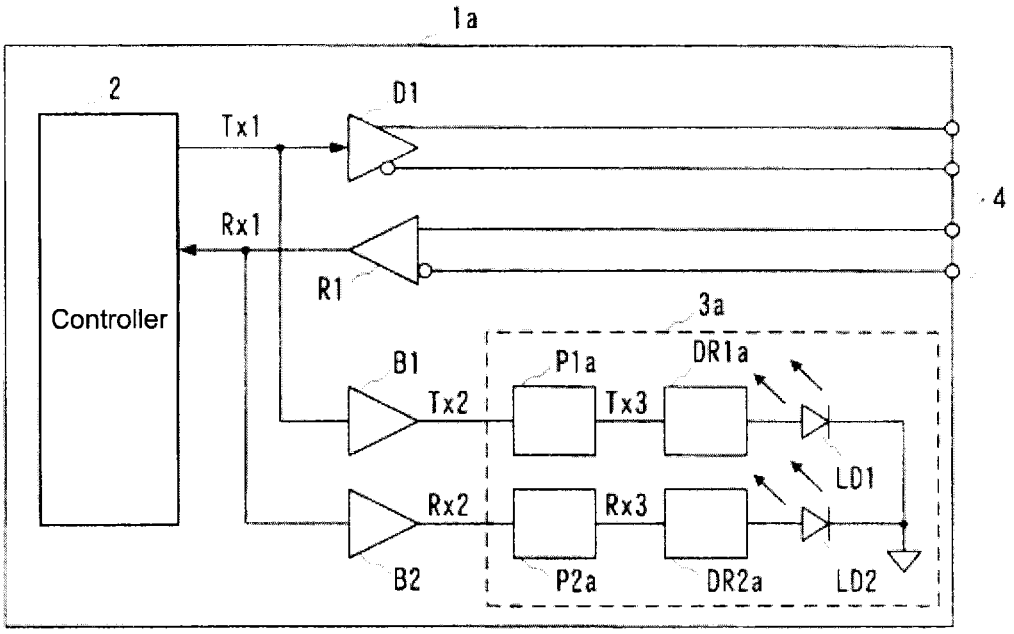
FIG. 5 is a block diagram showing the structure of a communication device according to a second embodiment of the present disclosure.

In the first embodiment, the case where the indicator is turned on by flowing current to the transmission state indicator LD1 or the reception state indicator LD2 when the transmission signal Tx2 or the received signal Rx2 having a positive pulse (whose voltage level is switched from low, to high, and to low again) is input has been described. However, the indicator may be turned on by flowing current to the transmission state indicator LD1 or the reception state indicator LD2 when the transmission signal Tx2 or the received signal Rx2 having a negative pulse (whose voltage level is switched from high, to low, and high again) are input. FIG. 5 is a block diagram showing the structure of a communication device according to a second embodiment of the present disclosure. The same configurations as those according to the first embodiment will be denoted by the same reference numerals.

A communication device 1*a* according to this embodiment is provided in an industrial apparatus (not shown) or as a single apparatus, and includes the controller 2, a communication state display device 3*a*, the serial communication driver D1, the serial communication receiver R1, the buffer B1, and the buffer B2.

The communication state display device 3*a* includes the transmission state indicator LD1 made of an LED whose cathode is grounded, the reception state indicator LD2 made of an LED whose cathode is grounded, a transmission state indicator driving circuit DR1*a* configured to drive the transmission state indicator LD1, a reception state indicator driving circuit DR2*a* configured to drive the reception state indicator LD2, a transmission signal pulse stretching circuit P1*a* that is provided between the output terminal of the buffer B1 and the input terminal of the transmission state indicator driving circuit DR1*a* and is configured to stretch the pulse width of the transmission signal, and a reception signal pulse stretching circuit P2*a* that is provided between the output terminal of the buffer B2 and the input terminal of the reception state indicator driving circuit DR2*a* and is configured to stretch the pulse width of the reception signal.

Figure 6:
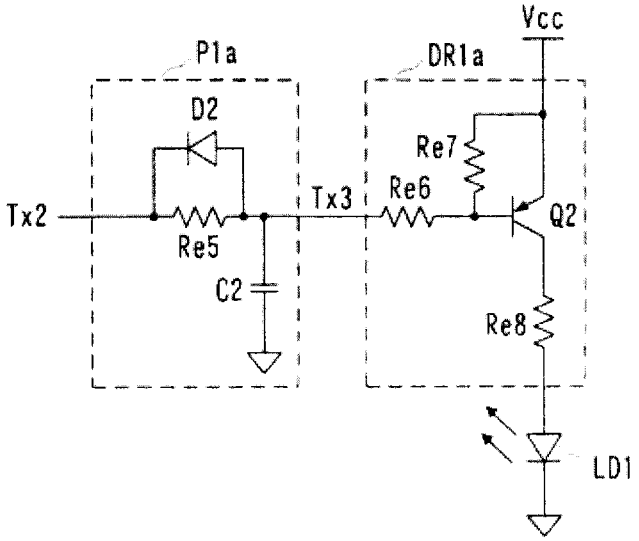
FIG. 6 is a circuit diagram showing an example of the structure of a transmission signal pulse stretching circuit and transmission state indicator driving circuit according to the second embodiment.

FIG. 6 is a circuit diagram showing an example of the structure of the transmission signal pulse stretching circuit P1*a* and the transmission state indicator driving circuit DR1*a* according to this embodiment. The transmission signal pulse stretching circuit P1*a* includes a diode D2 whose cathode is connected to the input terminal of the transmission signal pulse stretching circuit P1*a* (output terminal of the buffer B1) and whose anode is connected to the output terminal of the transmission signal pulse stretching circuit P1*a* (input terminal of the transmission state indicator driving circuit DR1*a*), a resistor Re5 whose one end is connected to the input terminal of the transmission signal pulse stretching circuit P1*a* and whose other end is connected to the output terminal of the transmission signal pulse stretching circuit P1*a*, and a capacitor C2 whose one end is connected to the output terminal of the transmission signal pulse stretching circuit P1*a* and whose other end is grounded.

The transmission state indicator driving circuit DR1*a* includes a PNP transistor Q2 whose emitter is connected to the power source voltage Vcc, a resistor Re6 whose one end is connected to the input terminal of the transmission state indicator driving circuit DR1*a* and whose other end is connected to the base of the transistor Q2, a resistor Re1 whose one end is connected to the other end of the resistor Re6 and the base of the transistor Q2 and whose other end is connected to the power source voltage Vcc, and a resistor Re8 whose one end is connected to the collector of the transistor Q2 and whose other end is connected to the output terminal of the transmission state indicator driving circuit DR1*a* (anode of the transmission state indicator LD1).

Figure 7:
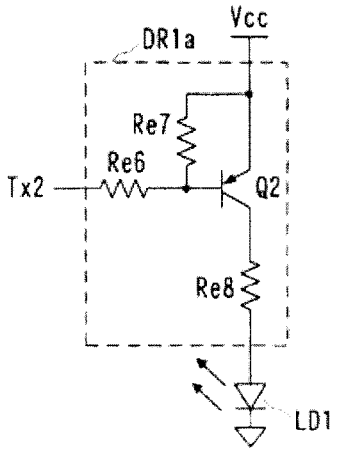
FIG. 7 is a circuit diagram showing an example of the structure of an existing communication state display device.

FIG. 7 is a circuit diagram showing an example of the structure of an existing communication state display device. Here, only the structure on the side of the transmission signal is shown. From FIG. 6 and FIG. 7, it can be seen that the communication state display device 3*a* according to this embodiment is obtained by adding the transmission signal pulse stretching circuit P1*a* and the reception signal pulse stretching circuit P2*a* to the existing communication state display device.

Figure 8:
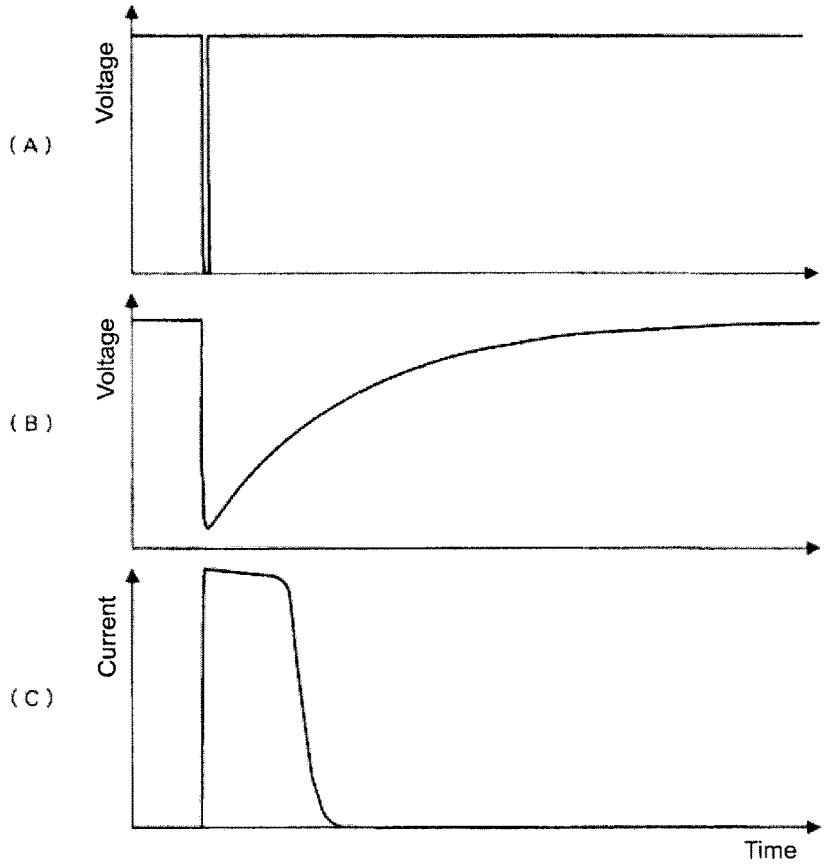
FIG. 8 is a diagram showing the signal waveform of each unit of the transmission signal pulse stretching circuit and transmission state indicator driving circuit according to the second embodiment.

FIGS. 8A, 8B, and 8C are each a diagram showing the signal waveform of each unit of the transmission signal pulse stretching circuit P1*a* and the transmission state indicator driving circuit DR1*a*. FIG. 8A is a diagram showing the voltage waveform of the transmission signal Tx2 input from the buffer B1 to the transmission signal pulse stretching circuit P1*a*, FIG. 8B is a diagram showing the voltage waveform of the transmission signal Tx3 whose pulse width has been stretched by the transmission signal pulse stretching circuit P1*a*, and FIG. 8C is a diagram showing the waveform of the current flowing through the transmission state indicator LD1.

If the transmission signal Tx2 of 1-bit data shown in FIG. 8A in serial communication is input to the transmission signal pulse stretching circuit P1*a*, the transmission signal Tx3 having a waveform shown in FIG. 8B is input to the transmission state indicator driving circuit DR1*a*. Specifically, the diode D2 does not delay the falling of the signal, and transmits the signal as it is. The resistor Re5 and the capacitor C2 delay the rising of the signal, and thus the pulse width is stretched. Because the transistor Q2 is turned on in response to the voltage whose pulse width has been stretched as described above, the turn-on time period of the transistor Q2 is prolonged as compared with that in the existing communication state display device, resulting in a longer time period during which the current flows through the transmission state indicator LD1 as shown in FIG. 8C.

In the above, the description has been made using the transmission signal pulse stretching circuit P1*a* and the transmission state indicator driving circuit DR1*a* as an example. However, the configuration of the reception signal pulse stretching circuit P2*a* is the same as that of the transmission signal pulse stretching circuit P1*a*, and the configuration of the reception state indicator driving circuit DR2*a* is the same as that of the transmission state indicator driving circuit DR1*a*.

As described above, even in the case where the indicator is turned on by flowing current to the transmission state indicator LD1 or the reception state indicator LD2 when the transmission signal Tx2 or the received signal Rx2 of the negative pulse are input, it is possible to obtain the same effects as those in the first embodiment.

It should be noted that the embodiments of the present disclosure can be applied to the half-duplex communication although examples of full duplex communication of RS485 are described in FIG. 1 and FIG. 5. In addition, examples of general-purpose serial communication to which the embodiments of the present disclosure can be applied include RS 232.

The embodiments of the present disclosure can be applied to the techniques for checking the communication state in general-purpose serial communication.

What is claimed is:

1. A communication state display method, the method being used to check a communication state of a communication device that transmits/receives signals to/from a different apparatus by serial communication, the method comprising:

stretching a pulse width of a signal transmitted/received between the communication device and the different apparatus by serial communication; and causing current to flow through an indicator in response to the signal having the stretched pulse width to light the indicator during the current flow, wherein the stretching step includes using a diode, not delaying rising of a positive pulse signal, the positive pulse signal being a 1-bit signal whose voltage level in serial communication is switched from low, to high, and to low again, and transmitting the positive pulse signal as it is when the positive pulse signal is input, and delaying falling of the positive pulse signal, using an RC circuit that includes a resistor and a capacitor, to stretch the pulse width, and the causing step includes causing current to flow through the indicator in response to the positive pulse signal generated in the stretching step.

2. A communication state display device of a communication device that transmits/receives signals to/from a different apparatus by serial communication, comprising:

an indicator driving circuit configured to cause current to flow through an indicator in response to an input signal to light the indicator during the current flow, and a pulse stretching circuit configured to stretch a pulse width of a signal transmitted/received between the communication device and the different apparatus by serial communication and to input the signal having the stretched pulse width to the indicator driving circuit, wherein the pulse stretching circuit includes a diode configured to not delay rising of a positive pulse signal, the positive pulse signal being a 1-bit signal whose voltage level in serial communication is switched from low, to high, and to low again, and to transmit the positive pulse signal as it is if the positive pulse signal is input to the pulse stretching circuit, and an RC circuit that includes a resistor and a capacitor and is configured to delay falling of the positive pulse signal to stretch the pulse width, and the indicator driving circuit is configured to cause current to flow through the indicator in response to the positive pulse signal input from the pulse stretching circuit.

3. A communication state display device of a communication device that transmits/receives signals to/from a different apparatus by serial communication, comprising:

an indicator driving circuit configured to cause current to flow through an indicator in response to an input signal to light the indicator during the current flow; and a pulse stretching circuit configured to stretch a pulse width of a signal transmitted/received between the communication device and the different apparatus by serial communication and to input the signal having the stretched pulse width to the indicator driving circuit, wherein the pulse stretching circuit includes a diode configured to not delay falling of a negative pulse signal, the negative pulse signal being a 1-bit signal whose voltage level in serial communication is switched from high, to low, to high again, and to transmit the negative pulse signal as it is if the negative pulse signal is input to the pulse stretching circuit, and an RC circuit that includes a resistor and a capacitor and is configured to delay rising of the negative pulse signal to stretch the pulse width, and the indicator driving circuit is configured to cause current to flow through the indicator in response to the negative pulse signal input from the pulse stretching circuit.

4. A communication state display method, the method being used to check a communication state of a communication device that transmits/receives signals to/from a different apparatus by serial communication, the method comprising:

stretching a pulse width of a signal transmitted/received between the communication device and the different apparatus by serial communication; and causing current to flow through an indicator in response to the signal having the stretched pulse width to light the indicator during the current flow, wherein the stretching step includes using a diode, not delaying falling of a negative pulse signal, the negative pulse signal being a 1-bit signal whose voltage level in serial communication is switched from high, to low, to high again, and transmitting the negative pulse signal as it is when the negative pulse signal is input, and delaying rising of the negative pulse signal, using an RC circuit that includes a resistor and a capacitor, to stretch the pulse width, and the causing step includes causing current to flow through the indicator in response to the negative pulse signal generated in the stretching step.

* * * * *